US005951824A

United States Patent [19]

Deshpande

[11] Patent Number: 5,951,824

[45] Date of Patent: Sep. 14, 1999

[54] COMPLIANT HYDRODYNAMIC/ HYDROSTATIC SHOE FOR PAPERMAKING PRESS

[75] Inventor: Rajendra D. Deshpande, Rockton, Ill.

[73] Assignee: Beloit Technologies, Inc., Wilmington, Del.

[21] Appl. No.: 08/878,611

[22] Filed: Jun. 19, 1997

[51] Int. Cl.[6] ..... D21F 3/06

[52] U.S. Cl. ..... 162/358.3; 162/361

[58] Field of Search ..... 162/358.3, 361, 162/358.4, 358.5

[56] References Cited

U.S. PATENT DOCUMENTS

| | | | |
|---|---|---|---|
| 4,552,620 | 11/1985 | Adams | 162/358.4 |
| 4,825,520 | 5/1989 | Alajoutsijärvi et al. | 29/116.1 |
| 5,110,417 | 5/1992 | Lehtonen et al. | 162/358.3 |
| 5,167,768 | 12/1992 | Cronin et al. | 162/205 |
| 5,223,100 | 6/1993 | Schiel et al. | 162/358.3 |
| 5,262,011 | 11/1993 | Ilmarinen | 162/358.3 |
| 5,286,245 | 2/1994 | Schiel | 492/7 |
| 5,302,252 | 4/1994 | Gotz | 162/358.3 |
| 5,338,279 | 8/1994 | Schiel | 492/7 |
| 5,389,205 | 2/1995 | Pajula et al. | 162/205 |
| 5,423,939 | 6/1995 | Bryant et al. | 216/18 |
| 5,423,949 | 6/1995 | Ilmarinen | 162/358.3 |
| 5,441,604 | 8/1995 | Sandberg et al. | 162/205 |

FOREIGN PATENT DOCUMENTS

| | | | |
|---|---|---|---|
| 3030233 | 2/1982 | Germany | 162/361 |

*Primary Examiner*—Karen M. Hastings
*Attorney, Agent, or Firm*—Lathrop & Clark LLP

[57] ABSTRACT

A press of the Beloit Extended Nip® type has a nip defined between a backing roll and an elongate shoe. A paper web travels on a dryer felt through the nip and is supported over the shoe by a bearing blanket. The shoe has a rigid concave core to which is fixed a layer of compliant material which defines a concave surface. Lubricant is introduced between the compliant material and the bearing blanket to form a hydrodynamic fluid film. Preferably the rigidity of the compliant material is of the same or lesser order of magnitude than the rigidity of the fluid film at the center of the shoe in the machine direction, such that the fluid film at the nip causes a depression in the compliant material which is filled with lubricant. The thickness of the lubricant is thus greater at the center of the shoe than at regions outward from the shoe center and the escape of lubricant from the shoe is retarded. The compliant material comprises an elastomer with a low coefficient of friction and high abrasion resistance. It has the ability to deform with increased pressure upon it, thus allowing a paper wad or web deformity to pass through the nip without damage to the bearing blanket. Alternatively, the compliant layer may define a plurality of lubricant pockets.

32 Claims, 8 Drawing Sheets

COMPLIANT HYDRODYNAMIC/ HYDROSTATIC SHOE FOR PAPERMAKING PRESS

FIELD OF THE INVENTION

The present invention relates to an Extended Nip® press apparatus for pressing water from a web of paper. More particularly, the present invention relates to a press apparatus having an elongate shoe with a concave surface.

BACKGROUND OF THE INVENTION

Presses which employ a concave shoe engaged against a backing roll, such as the Extended Nip® press manufactured by Beloit Corporation of Beloit, Wis., are used in a papermaking machine for increasing the residence time of a web during passage of the web through a pressing nip. Typically, a nip is defined as the narrow region about the line of co-tangency when two rolls with aligned axes are brought together. The nip between rolls has classically been used in papermaking to remove water from the web, and to compress the fibers in the web into a smooth surface. In the papermaking art, it has been found to be desirable to increase the length of the nip, resulting in a somewhat lower pressure and uniform pressing, and increased effectiveness of pressing of the paper web. Initially, the length of the nip was increased by coating one or both of the rolls with a compliant material. The use of a compliant roll system allowed for nips somewhat greater than an inch in length along the direction of the web through the nip.

The desire for even longer nips led to the development of the so-called Extended Nip® press, or ENP. The ENP employs a backing roll and an elongated shoe, where the elongated shoe has a concave surface with a radius of curvature slightly larger than that of the convex surface of the backing roll. The shoe, which is typically made of steel, cooperates with the backing roll over a nip length of approximately ten inches along the direction of travel of the paper web.

In this configuration, the shoe is stationary. Thus, without further modification, a paper web moving through the nip formed between the shoe and the backing roll would experience unacceptable rubbing on the stationary shoe. To overcome this problem, a bearing blanket forming a cylindrical tube is slidably disposed over the shoe and around the support shaft on which the shoe is mounted. This bearing blanket supports the paper web as it passes through the nip. To reduce friction forces between the bearing blanket and the shoe, lubricant is supplied between the bearing blanket and the shoe, allowing the bearing blanket to slide freely across the shoe on a film of lubricant. A shoe of this type is known as a hydrodynamic shoe.

The type of lubricant used affects the thickness of the film layer. Higher viscosity lubricants create thicker film layers than do low viscosity lubricants; however, increased horsepower is needed to drive the backing roll. In addition, as the rotational speed of the backing roll decreases, the thickness of the film layer decreases. Thus, where the backing roll is operating at low speed, it is difficult to maintain the film layer.

To aid in drying or pressing of the paper web, a felt, or web support blanket, often underlies and supports the paper web as it transits the nip between the backing roll and the bearing blanket on the shoe. The backing rolls, paper web, and web support blanket (if present) are frictionally engaged, and in turn engage the upper surface of the bearing blanket, causing the bearing blanket to slide over the shoe and rotate about the shoe and its support shaft.

A typical papermaking machine of which the Extended Nip® Press forms a part can produce over one-half million square feet of paper per hour of operation. Thus, it is desirable that the machine be in operation as close to continuously as possible, with downtime for repair or replacement of parts being kept to a bare minimum. One part that is subject to replacement is the bearing blanket. As stated above, it is subject to friction forces as it rotates about the shoe and the shoe support shaft. Due to the large pressure force in the nip, the bearing blanket can also be damaged by paper wads or other deformation in the paper web that cause the lubricant film layer between the shoe and blanket to collapse. Blankets cost from about $100,000 to $200,000 each, so blanket damage from paper wads or other web deformities is a serious problem in the papermaking industry. Further, it takes from four to eight hours to replace a blanket, during which time no paper can be made.

In an attempt to minimize such damage to the bearing blanket, various shoe configurations have been proposed. One such configuration is known as a hydrostatic shoe. In a hydrostatic shoe, the concave portion of the shoe defines a pocket, so that at least for a portion of the travel of the bearing blanket through the nip, the blanket is hydrostatically supported with lubricant within the pocket. For example, in U.S. Pat. No. 5,262,011 to Ilmarinen ("the '011 patent"), pockets are disclosed having several pocket zones where the trailing edge of the pocket decreases to zero depth. Lubricant is supplied directly to the pocket by channel means passing through the shoe.

One of the objectives of the '011 patent is to provide a shoe configuration whereby damage to the bearing blanket from a paper wad entering the nip is reduced. However, if the hydrostatic pocket abruptly terminates at the trailing end thereof, there is a tendency for a paper wad to cause a sudden pressure surge as the wad moves between the blanket and the concave surface at the trailing end of the pocket, thus collapsing the lubricant film layer.

U.S. Pat. No. 5,441,604 to Sandberg et al. ("the '604 patent") also discloses a hydrostatic shoe, where the concave surface encompasses a pocket. In the shoe of the '604 patent, lubricant is supplied onto the concave surface upstream from the pocket and flows into the pocket. The pocket acts to relieve pressure on the bearing blanket caused by a paper wad entering the nip.

Both hydrodynamic shoes and hydrostatic shoes have rigid steel concave surfaces.

As a result, tight tolerances are required to maintain a sufficient lubricant film between the shoe and the bearing blanket. This is difficult and expensive to accomplish, due to the large surface area of the shoe. Moreover, hydrostatic shoes are expensive to manufacture, because the pockets therein must be machined to exact dimensions.

Thus, there exists a need for an elongate shoe that is easier and less expensive to manufacture, and that does not require tight tolerances. There also exists a need for an elongate shoe which can increase bearing blanket life, by significantly reducing damage to the blanket from paper wads and web deformities passing through the nip.

SUMMARY OF THE INVENTION

The Extended Nip® press apparatus of this invention comprises a rotatable backing roll and an elongate shoe that cooperates with the backing roll for defining therebetween a nip of extended length for passage therethrough of a paper web. The shoe defines a concave surface, where that surface has a layer of a compliant material thereon.

A bearing blanket is movably disposed between the backing roll and the compliant material layer on the concave surface. The arrangement is such that the paper web is supported by the bearing blanket, with the web being disposed between the blanket and the backing roll.

Lubricant supply means are provided for supplying lubricant between the compliant material layer on the concave surface and the bearing blanket, such that the bearing blanket is slidingly supported by the compliant material layer on the concave surface during passage of the blanket through the nip.

The compliant material layer comprises an elastomer with a low coefficient of friction and high abrasion resistance. It has the ability to deform with increased pressure upon it, thus allowing a paper wad or web deformity to pass through the nip without damage to the bearing blanket.

It is a feature of the present invention to provide a concave shoe for a press apparatus which is economical to manufacture.

It is another feature of the present invention to provide an elongate press shoe which can increase bearing blanket life by reducing damage to the blanket from paper wads and web deformities passing through a nip.

It is also a feature of the present invention to provide a shoe which can contribute to reduced drive horsepower requirements, even where high viscosity lubricants are used.

Further objects, features and advantages of the invention will be apparent from the following detailed description when taken in conjunction with the accompanying drawings.

DESCRIPTION OF THE PREFERRED EMBODIMENTS

Figure 1:
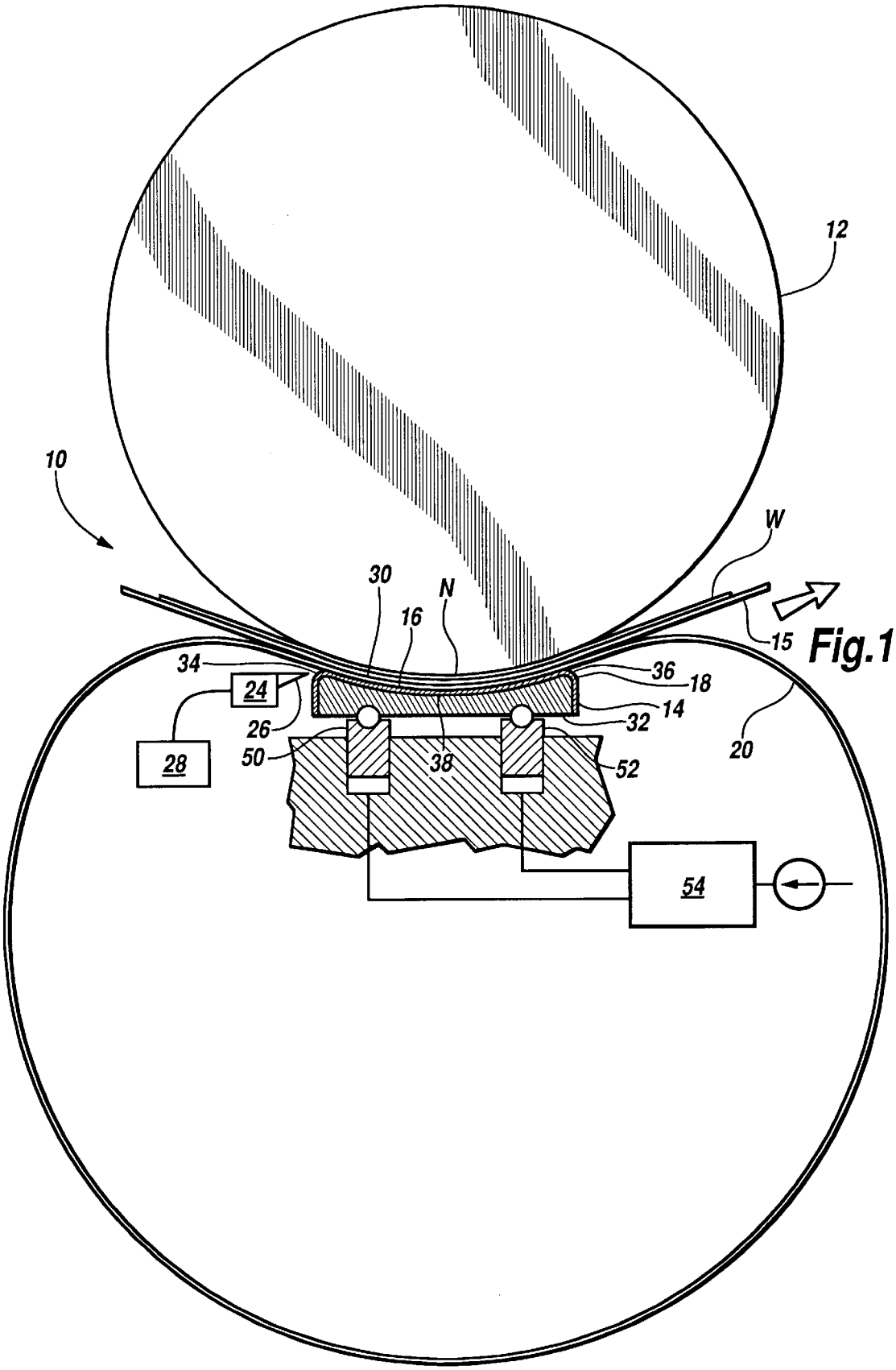
FIG. 1 is a side elevational view of an Extended Nip® press apparatus of the present invention employing a hydrodynamic shoe.
Figure 2:
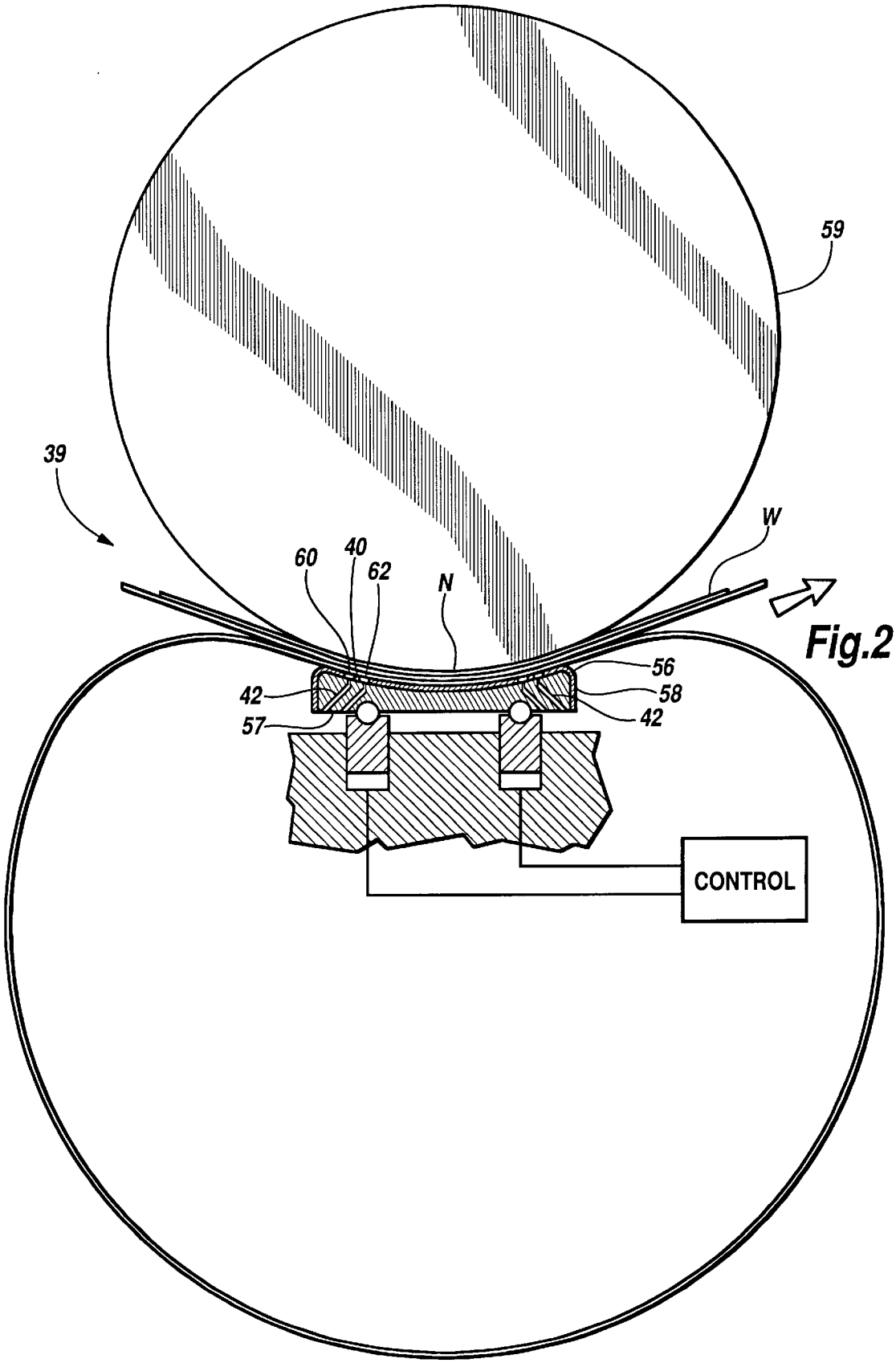
FIG. 2 is a side elevational view of an alternative embodiment Extended Nip® press apparatus of the present invention, employing a hydrostatic shoe.

Referring more particularly to FIGS. 1–2, wherein like numbers refer to similar parts, an Extended Nips press apparatus 10 for removing water from paper web W is shown in FIG. 1. The apparatus includes a rotatable backing roll 12 and an elongate shoe 14, which cooperates with the backing roll 12 for defining therebetween a nip N. The shoe 14 defines a concave surface 16, which has a layer of compliant material 18 thereon. The term "compliant material" encompasses any material that is capable of being deformed or compressed due to pressure forces exerted upon it of a magnitude similar to those present in the nip N during operation of the apparatus 10. The nip N, which is typically about ten inches long, forces the paper web W into extended and high pressure contact with the backing roll 12. The extended high pressure passage through the nip N is advantageously used in presses, impulse dryers, and the like, to speed the removal of water, or drying, of the paper web W in a papermaking machine. Typically the web W will be supported on a felt or dryer fabric 15 as it passes through the nip N.

A first support means 50 such as a hydraulically driven piston cooperates with the elongate shoe 14 for urging the shoe 14 towards the backing roll 12. A second support means 52 is disposed upstream relative to the first support means 50. The second support means 52 cooperates with the elongate shoe 14 for urging the shoe 14 towards the backing roll 12. A control means 54 is connected to both the first support means 50 and the second support means 52, for controlling the disposition of the first support means 50 and the second support means 52 and hence the shoe 14. The arrangement is such that the application of differential pressure in a machine direction is permitted.

In order to lower the friction between the paper web W and the shoe 14, a lubricated endless bearing blanket 20 is movably disposed, as indicated by arrow 22, between the backing roll 12 and the layer of compliant material 18 on the concave surface 16 of the shoe. The arrangement is such that the paper web W is disposed between the bearing blanket 20 and the backing roll 12. Means 24, are provided for supplying lubricant between the layer of compliant material 18 on the concave surface 16 of the shoe 14 and the blanket 20, such that the blanket is slidingly supported by the layer of compliant material 18 during passage of the blanket 20 through the nip N.

The means 24 for supplying lubricant is disposed upstream relative to the shoe 14. The means 24 includes a plurality of nozzles 26 connected to a pressurized supply of lubricant 28, such that the lubricant 30 is applied to the upstream end 32 of the shoe 14 between the surface of the compliant material 18 and the blanket 20. The lubricant 30 then moves downstream in the form of a lubricant film, whose thickness varies, based on the pressure exerted upon it.

The layer of compliant material 18 comprises an elastomer having a low coefficient of friction and high abrasion resistance. So that the compliant material layer 18 can be deformed by pressure from the lubricant film, the elastomer should be less rigid than the rigidity exhibited by the lubricant film as it passes over the compliant material layer 18. Elastomers having a hardness of from about 30 to about 90, measured by a shore A durometer are preferred. Suitable elastomers for use in the compliant material layer include nitrile rubber, fluoroelastomers, plastics and proprietary elastomers, such as 10+742 Slick Elastomer, available from John Crane Inc., Vandalia, Ill. These materials can also be reinforced with polyester fabric. In addition to polyester fabric reinforcements, the materials may be reinforced with nylon, cotton, KELVAR® (a brand of aromatic polyamide fibers), metal, carbon or any other fabric. KELVAR is a trademark for a polymer material manufactured by E. I. du Pont de Nemours and Company, Wilmington, Del. They may also be coated with TEFLON® (a brand of tetrafluoroethylene fluorocarbon polymers) to obtain a lower coefficient of friction.

The compliant material layer 18 can be attached to the concave rigid metal core 32 of the shoe 14 by various methods known in the art, such as bonding, coating or otherwise attaching the compliant material to form the concave surface 16.

Figure 3:
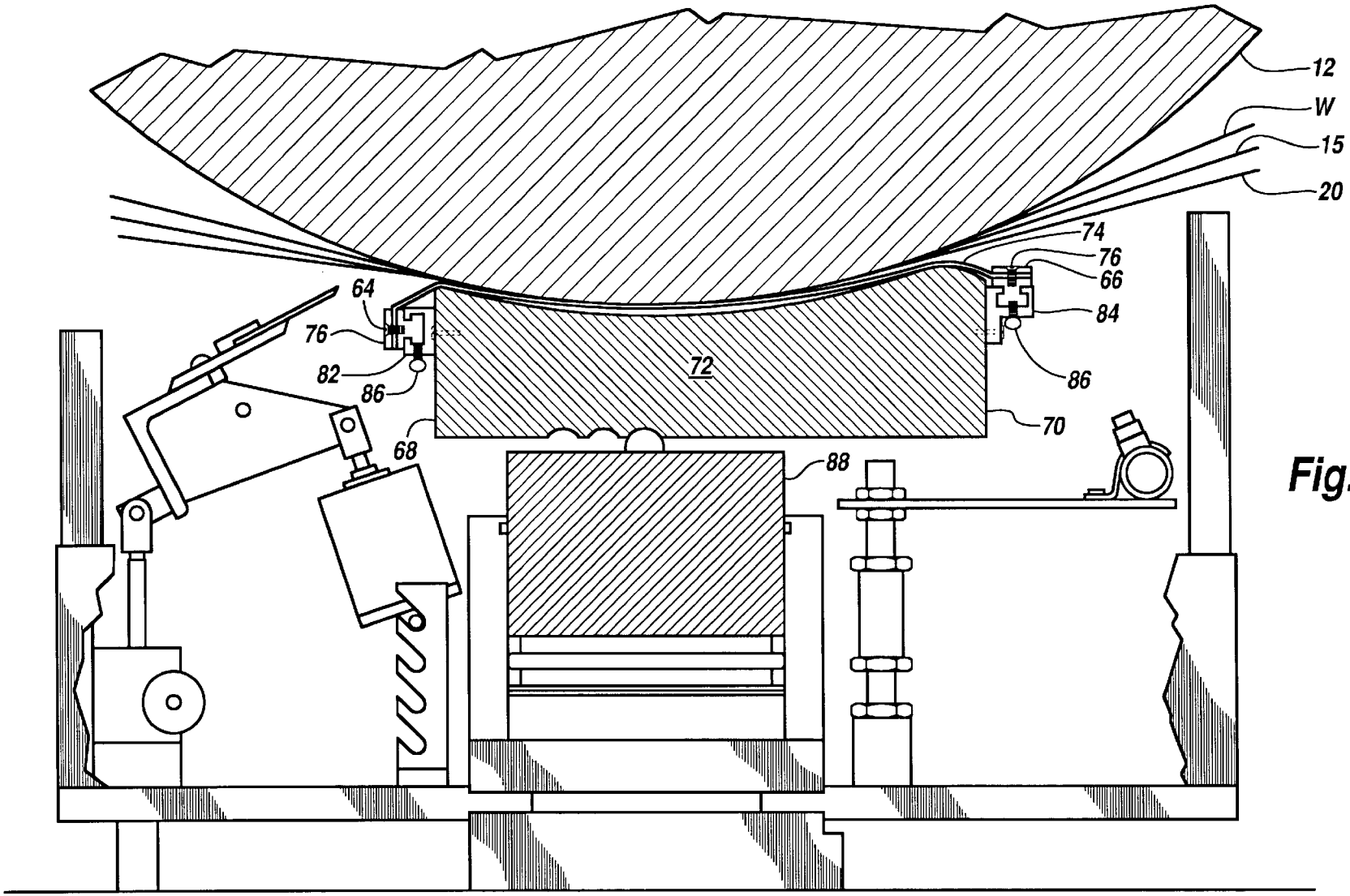
FIG. 3 is a side elevational view of an Extended Nip® press apparatus of the present invention, illustrating means for attaching the a compliant layer to the shoe.
Figure 8:
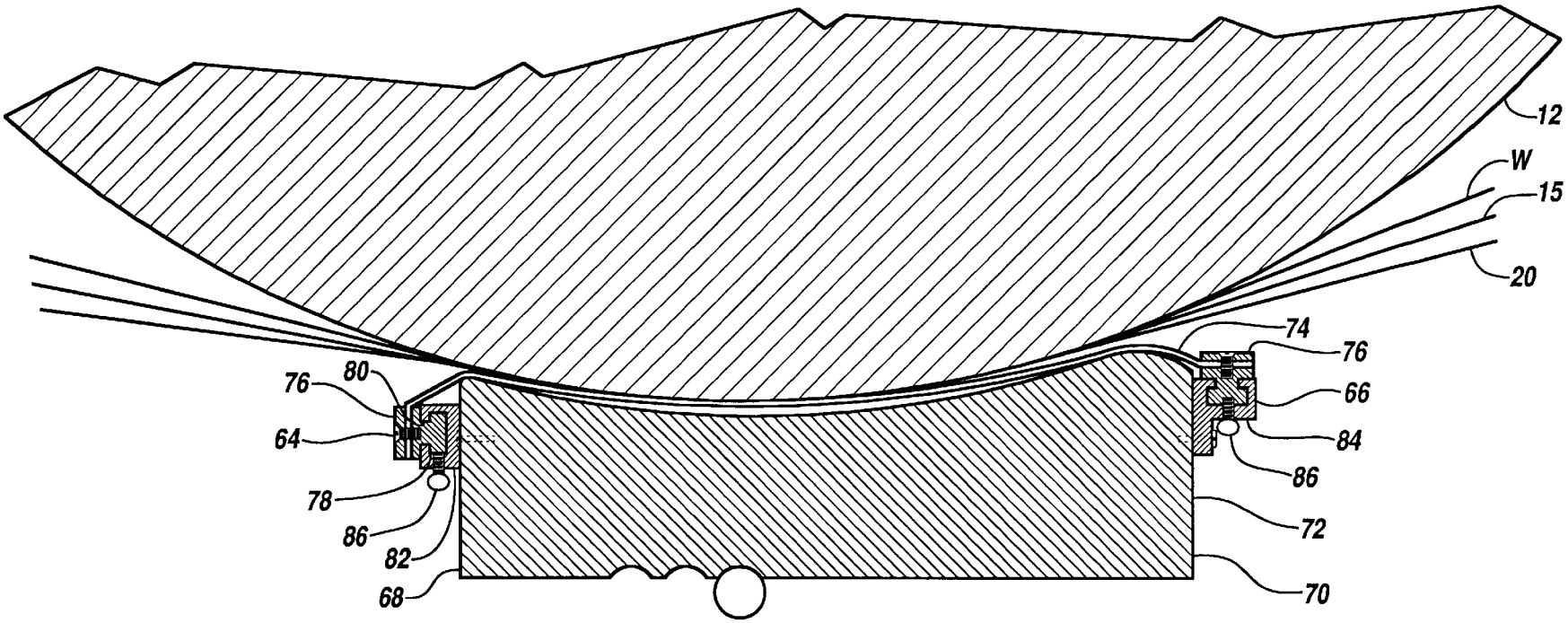
FIG. 8 is an enlarged fragmentary cross-sectional view of the nip of FIG. 3.

Preferably, as shown in FIGS. 3 and 8, the compliant material layer 74 can be attached to the shoe 72 by clamping means 64 and 66, which are located at upstream end 68 and downstream end 70 respectively of the shoe. The shoe is supported and moved toward and away from the backing roll 12 by a piston 88. This configuration allows for easy and rapid replacement of the compliant material layer 74. The layer of compliant material 74 should be of a thickness to allow for it to deform sufficiently from pressure generated by passage of a paper wad or web deformity through the nip so that the bearing blanket is not subjected to a sudden, deleterious pressure increase from the presence of the paper wad or web deformity in the nip. Preferably, the thickness of the compliant material layer should be uniform. A preferred thickness for the compliant material layer is from about 0.1 to about 0.5 inches, however, greater or lesser thicknesses may be employed.

As shown in FIG. 8, the compliant material layer 74 is connected by fasteners to edge clamps 76. The edge clamps have parallel grooves 78 which receive protrusions 80 from an upstream bracket 82 and a downstream bracket 84, such that the comparatively thin compliant layer material 74 can be clamped to the edge clamps 76 off-machine, and the rigid edge clamps 76 then expeditiously inserted in the brackets 82, 84 and properly positioned and fixed in place by adjustment of a plurality of set screws 86 or the like.

During operation of the press apparatus 10, pressure generated by the lubricant film causes the layer of compliant material to compress in thickness. Since the pressure from the lubricant film is less at the upstream and downstream edges 34, 36 of the concave surface 16 than it is towards the center 38 of the concave surface 16, the compliant material 18 will compress in thickness more at the center 38, than at the edges 34, 36, causing the formation of a shallow pressure "puddle," or pocket, in which the lubricant film is maintained. In addition, the thickness of the lubricant film at the edges 34, 36 will be less than that at the center 38, which acts to retard the escape of lubricant from the shoe 14, and permits a continuous lubricant film to be established. Since less lubricant escapes, the feed rate of lubricant 30 from the lubricant supply 28 can be less in the present invention than is necessary in an Extended Nip® press apparatus of conventional design.

As a paper wad or other web deformity enters the nip N, the pressure caused by the wad or deformity causes the layer of compliant material to compress in thickness, thereby substantially absorbing the additional pressure generated by the paper wad or web deformity, and allowing for its passage though the nip without damage to the bearing blanket.

An alternative embodiment press apparatus 39 of the present invention is shown in FIG. 2 employing a primarily hydrostatic type shoe. The apparatus 39 has a shoe 58 disposed below a backing roll 59. The shoe 58 has one or more pockets 40 cut from the layer of compliant material 56 attached to the metal shoe core 57. Lubricant 30 is supplied to the pockets 40 via a lubricant supply channel 42. Alternatively, lubricant 30 can be supplied to the pockets 40 as in the apparatus 10 disclosed above and shown in FIG. 1, that is, through nozzles disposed at the upstream end of the shoe 58. The lubricant 30 will then flow downstream in a film into the pockets 40. Such a shoe should be less costly to manufacture than a hydrostatic shoe formed entirely from metal, as it is easier to cut an elastomeric material to form the pockets than it is to machine the pockets in an all-metal shoe.

The pockets 40 may be cut in any shape or dimension desired by the user. Preferably, the pockets are concave in shape, and decrease gradually in depth toward the upstream and downstream ends 60 and 62 of the pocket 40, respectively, to a zero depth at ends 60 and 62. However, other shapes, such as wedges or rectangles, can be used. The pockets should be of sufficient depth for laminar flow to occur therein.

The Extended Nip® press of the present invention has numerous advantages over conventional Extended Nip presses. As stated above, the compliant layer on the concave surface of the shoe protects the blanket from damage due to a paper wad or other web deformity. Further, the Extended Nip press of the present invention requires less horsepower to operate the press roll, and allows lower viscosity lubricants to be used, without sacrificing performance. These benefits have been demonstrated in actual testing of the Extended Nip press of the present invention, as is shown in the following examples.

EXAMPLE 1

A paper wad was passed through (1) an Extended Nip press apparatus having a steel hydrodynamic shoe, (2) an Extended Nip press apparatus having a steel hydrostatic shoe, and (3) an Extending Nip press apparatus of the present invention, where the concave surface of the hydrodynamic shoe had a compliant layer thereon, comprising a rubber layer having a thickness of 0.25 inches. The nip load force was set at 6,000 pounds per lineal inch ("pli") and the machine speed was 500 feet per minute ("fpm").

Figure 4:
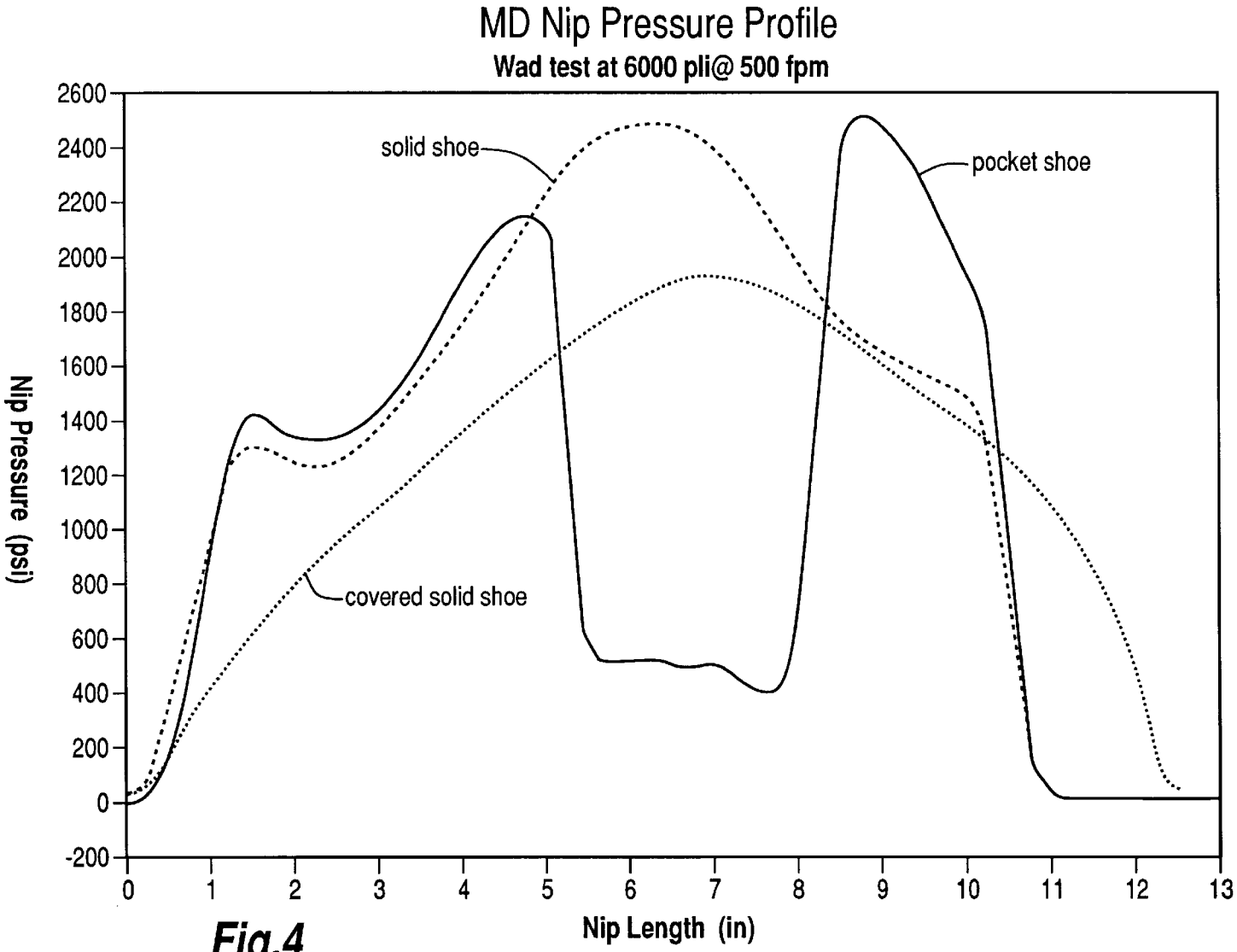
FIG. 4 is a graphical representation of the nip pressure profile caused by a paper wad for various prior art shoe configurations, and the shoe of the present invention having a concave surface with a layer of compliant material thereon.

As illustrated in FIG. 4, a nip pressure profile was determined for each of the presses discussed above. As can be seen in FIG. 4, the Extended Nip press of the present invention (dotted line) had a lower peak nip pressure level than either that exhibited by the Extended Nip press with the hydrodynamic shoe (dashed line), or the Extended Nip press with the hydrostatic shoe (solid line). Further, the nip pressure profile for the Extended Nip press of the present invention showed a more gradual pressure gradient than did the profiles of the other two presses.

Based on these results, a paper wad is much less likely to damage the blanket where the Extended Nip press apparatus has a compliant layer on the concave surface of the shoe, as compared to an Extended Nip press apparatus having either a solid hydrodynamic shoe or solid hydrostatic shoe.

EXAMPLE 2

Figure 5:
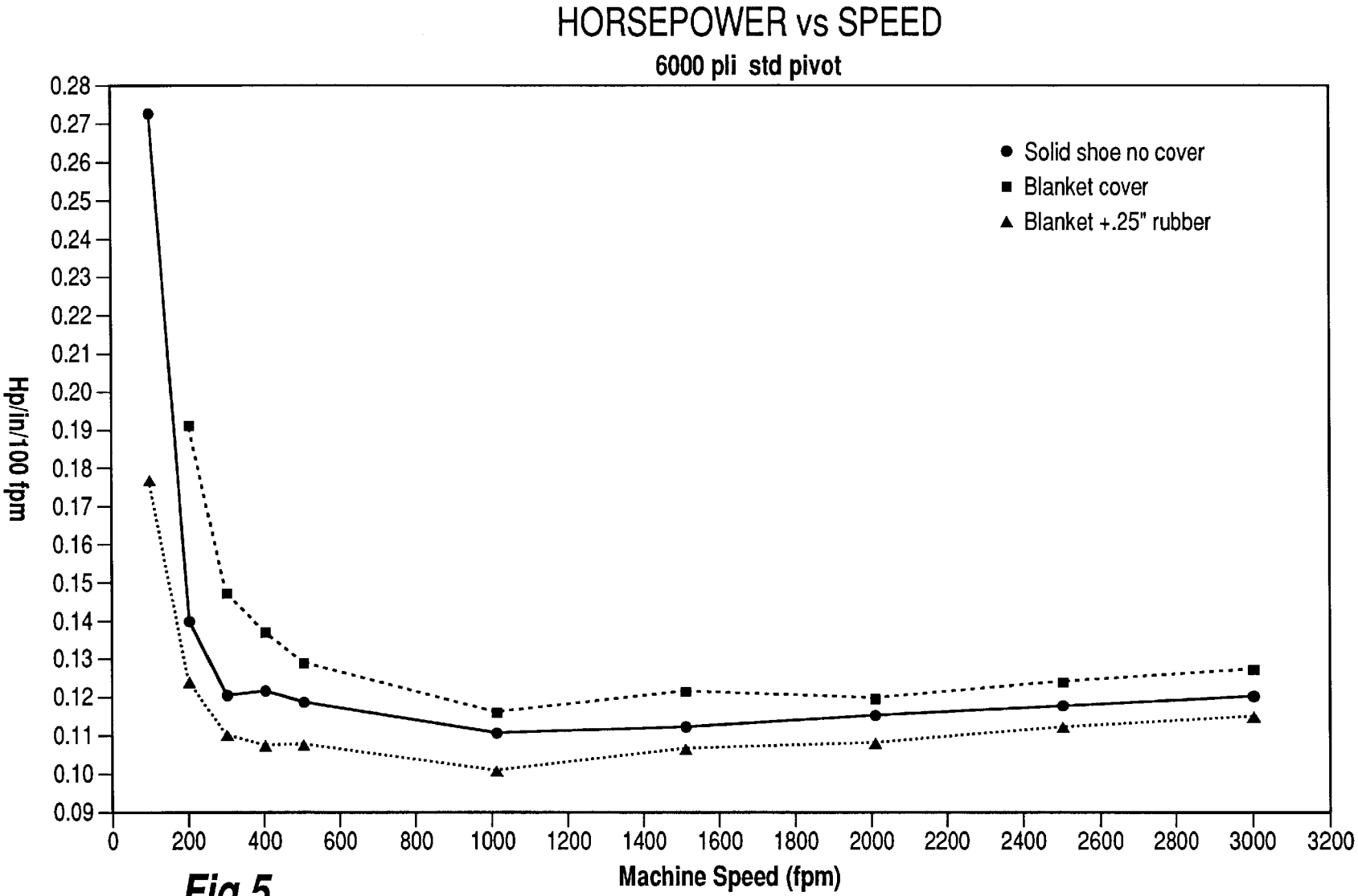
FIG. 5 is a graphical representation of horsepower versus machine speed for prior art shoe configurations and the shoe of the present invention having a concave surface with a layer of compliant material thereon.

FIG. 5 shows a plot of horsepower versus machine speed for (1) an Extended Nip press apparatus having a steel hydrodynamic shoe, and no blanket (circle points), (2) an Extended Nip press apparatus having a steel hydrodynamic shoe, with a blanket disposed between the shoe and the press roll (square points), and (3) an Extended Nip press apparatus of the present invention (triangle points), where the concave surface of the hydrodynamic shoe has a compliant layer thereon, comprising a rubber layer having a thickness of 0.25 inches, and a blanket is disposed between the compliant layer and the press roll. As shown in FIG. 5, for a given machine speed, the horsepower required to operate the press roll is less for the Extended Nip press apparatus of the present invention (dotted line), than that required to operate the press roll for an Extended Nip press apparatus having a conventional hydrodynamic shoe, with or without a blanket (dashed line and solid line, respectively).

Thus, use of the Extended Nip press of the present invention will require less energy than a conventional Extended Nip press apparatus.

EXAMPLE 3

Figure 6:
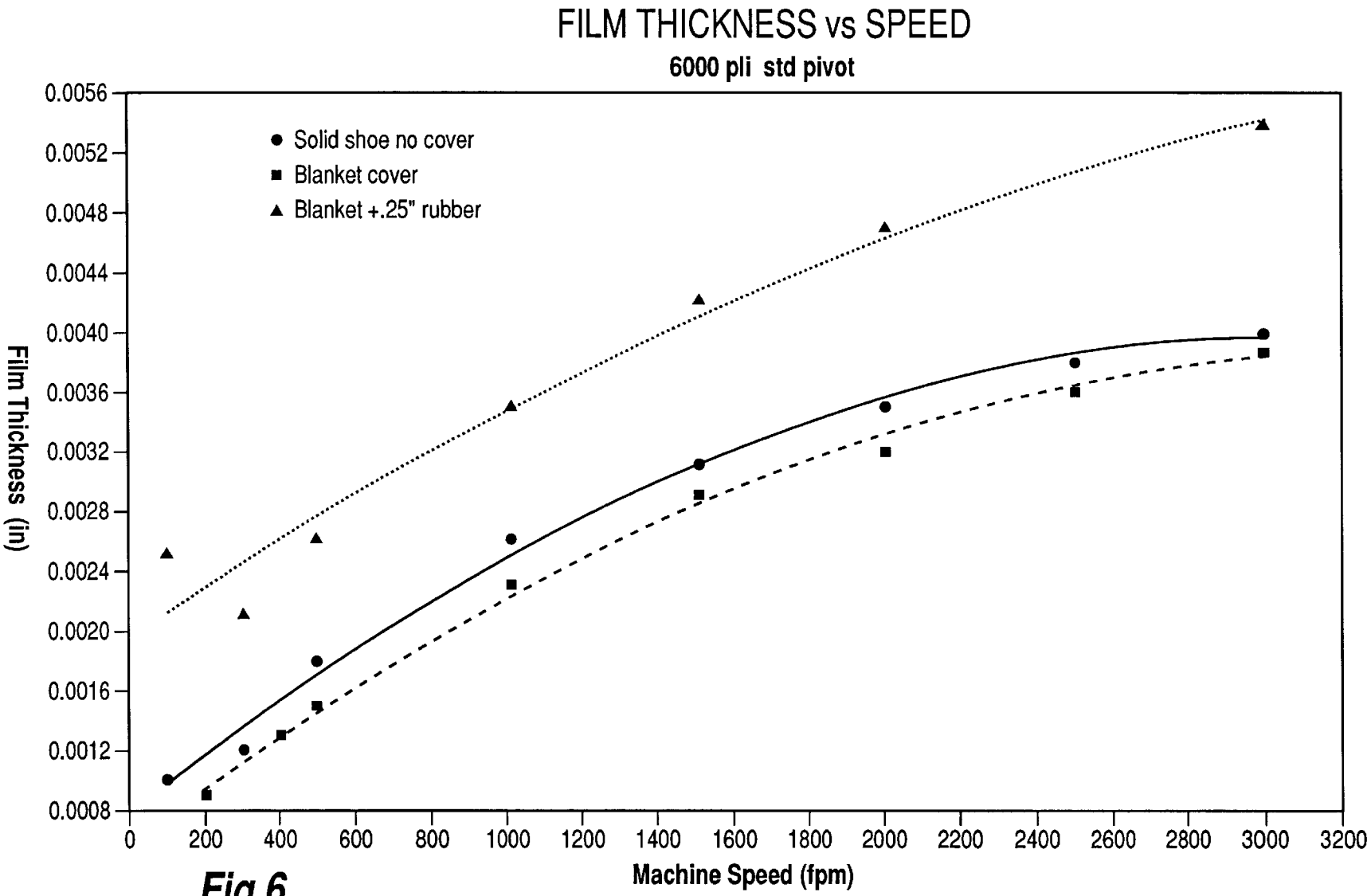
FIG. 6 is a graphical representation of lubricant film thickness versus machine speed for prior art shoe configurations and the shoe of the present invention having a concave surface with a layer of compliant material thereon.

FIG. 6 shows a plot of lubricant film thickness versus machine speed for the same three Extended Nip presses from Example 2, with similar characters indicating data from the different presses. As can be seen from the plot, for a given machine speed, at a nip load force of 6,000 pli, the Extended Nip press of the present invention maintains a significantly thicker lubricant film layer (dotted line) than does a conventional hydrodynamic shoe Extended Nip press with or without a blanket (dashed line and solid line, respectively).

Thus, the Extended Nip press of the present invention can maintain a sufficient film layer to avoid blanket damage at lower machine speeds than can a conventional Extended Nip press, and can maintain a sufficient film layer at a given speed using a lower viscosity lubricant than that required for a conventional Extended Nip press.

EXAMPLE 4

Figure 7:
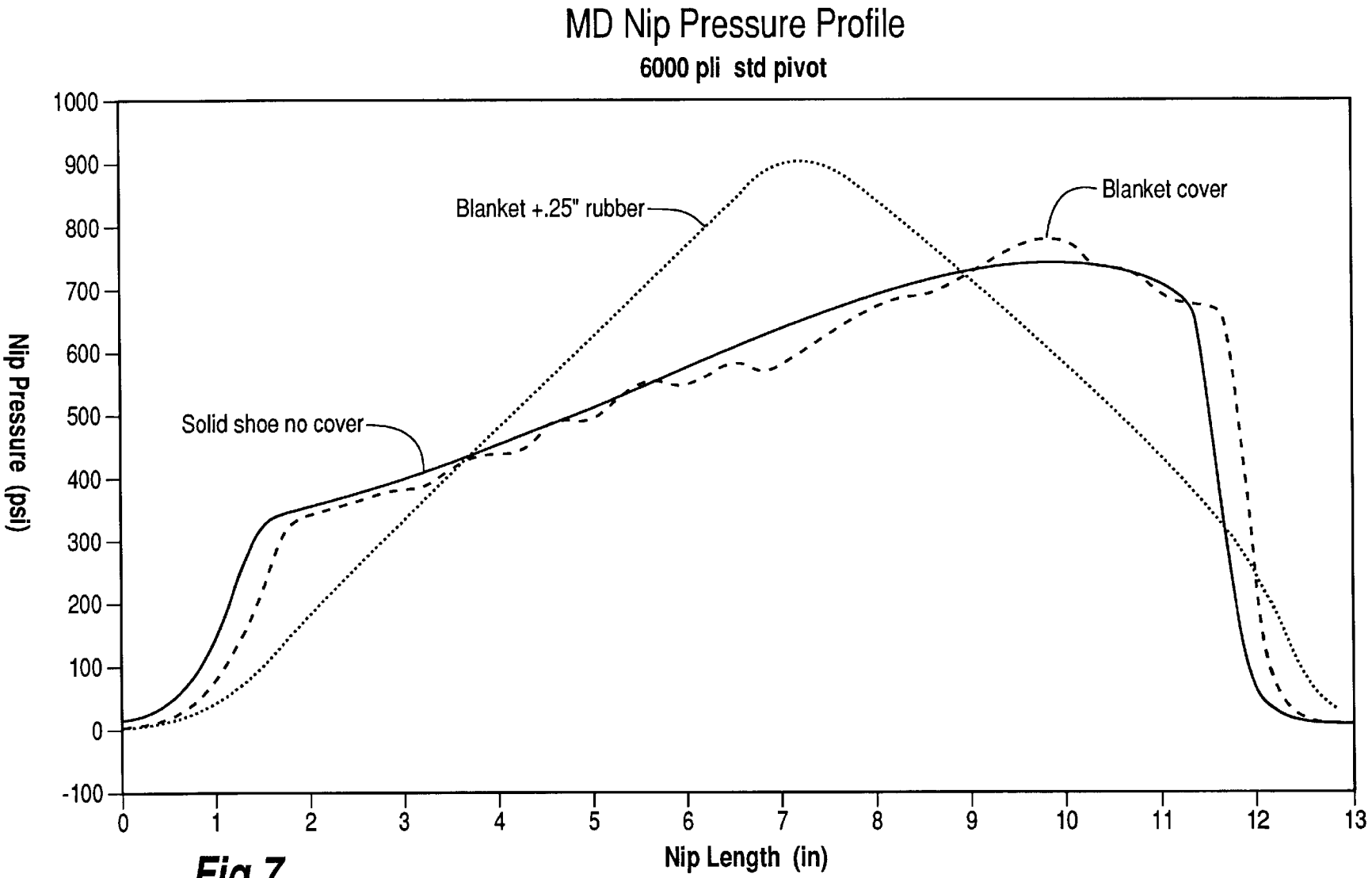
FIG. 7 is a graphical representation of the nip pressure profile for prior art shoe configurations and the shoe of the present invention having a concave surface with a layer of compliant material thereon.

FIG. 7 shows nip pressure profiles generated for each of the three Extended Nip presses from Example 2 during normal operation. As shown in FIG. 7, the nip pressure profile of the Extended Nip press of the present invention (dotted line) is similar to those of the conventional hydrodynamic Extended Nip press, with or without a blanket (dashed line and solid line, respectively).

Thus, the Extended Nip press of the present invention removes essentially the same amount of water from the web as does a conventional hydrodynamic Extended Nip press.

It is understood that the invention is not limited to the particular construction and arrangement of parts herein illustrated and described, but embraces such modified forms thereof as come within the scope of the following claims.

I claim:

1. A press apparatus for a papermaking machine, comprising:

a rotatably mounted backing roll;

an elongated shoe having a metal core with a concave surface, the shoe being urged with the concave surface facing the backing roll, toward the backing roll to define a nip therebetween for the passage therethrough of a paper web, wherein the concave surface has a layer of compliant material fixed thereon;

a bearing blanket movably disposed between the backing roll and the layer of compliant material; and means for supplying lubricant between the bearing blanket and the layer of compliant material, such that the blanket is slidingly supported by the layer of compliant material during passage of the blanket through the nip;

a first support means cooperating with the shoe urging the shoe towards the backing roll;

a second support means disposed upstream relative to the first support means, the second support means cooperating with the shoe for urging the shoe towards the backing roll; and control means connected to the first and second support means for controlling the first and second support means, the arrangement being structured such that the application of differential pressure in a machine direction is permitted.

2. The apparatus of claim 1, wherein the layer of compliant material comprises an elastomer.

3. The apparatus of claim 2, wherein the elastomer is selected from the group consisting of nitrile rubber, plastics, and fluoroelastomers.

4. The apparatus of claim 2, wherein the elastomer is coated with tetrafluoroethylene fluorocarbon polymers.

5. The apparatus of claim 2, wherein the elastomer is reinforced with polyester fabric.

6. The apparatus of claim 1, wherein the elastomer has a hardness of from about 30 to about 90 shore A durometer.

7. The apparatus of claim 1, wherein the layer of compliant material has a uniform thickness of from about 0.1 to about 0.5 inches.

8. The apparatus of claim 1, wherein the layer of compliant material is attached to the shoe by clamping means located at the upstream and downstream ends of the shoe.

9. The apparatus of claim 1, wherein the layer of compliant material comprises at least one pocket having a length in the machine direction of less than the length in the machine direction of the nip.

10. The apparatus of claim 9, wherein the lubricant is supplied directly into the pockets by means of a channel opening directly into each pocket.

11. The apparatus of claim 9, wherein the pocket is concave in shape.

12. The apparatus of claim 1, wherein the lubricant is supplied upstream relative to the concave surface.

13. A press apparatus in a papermaking machine comprising:

a backing roll;

a concave shoe having a metal core forming a concave surface facing the backing roll and a layer of compliant material connected to the metal core, the compliant material to define a second concave surface which faces the backing roll;

a bearing blanket which travels in sliding engagement over the shoe, wherein a paper web is supported on the bearing blanket and is conveyed on the blanket through a nip defined between the backing roll and the concave shoe; and a flow of lubricant introduced by a means for introducing the flow of lubricant between the compliant material and the bearing blanket to form a hydrodynamic fluid film, wherein the rigidity of the compliant material is of lesser order of magnitude than the rigidity of the fluid film at the center of the shoe in the machine direction, such that the fluid film at the nip causes a depression in the compliant material which is filled with lubricant, and wherein the thickness of the lubricant is greater at the center of the shoe than at regions outward from the shoe center in the machine direction, the escape of lubricant from the shoe being thereby retarded;

a first support means cooperating with the shoe urging the shoe towards the backing roll;

a second support means disposed upstream relative to the first support means, the second support means cooperating with the shoe for urging the shoe towards the backing roll; and control means connected to the first and second support means for controlling the first and second support means, the arrangement being structured such that the application of differential pressure in a machine direction is permitted.

14. The press apparatus of claim 13 wherein the means for introducing the flow of lubricant is positioned upstream of the shoe.

15. The apparatus of claim 13, wherein the layer of compliant material comprises an elastomer.

16. The apparatus of claim 15, wherein the elastomer is selected from the group consisting of nitrile rubber, plastics, and fluoroelastomers.

17. The apparatus of claim 15, wherein the elastomer is coated with tetrafluoroethylene fluorocarbon polymers.

18. The apparatus of claim 15, wherein the elastomer is reinforced with polyester fabric.

19. The apparatus of claim 15 wherein the elastomer is reinforced with a fabric constructed of fibers selected from the group consisting of nylon, cotton, aromatic polyamide, metal, and carbon.

20. The apparatus of claim 15, wherein the elastomer has a hardness of from about 30 to about 90 shore A durometer.

21. The apparatus of claim 13, wherein the layer of compliant material has a uniform thickness of from about 0.1 to about 0.5 inches.

22. A press apparatus in a papermaking machine comprising:

a backing roll;

a concave shoe having a metal core with a concave surface which faces the backing roll and a layer of compliant material connected to the core and overlying the concave surface to define a second concave surface which faces the backing roll;

a bearing blanket which travels in sliding engagement over the shoe, wherein a paper web is supported on the bearing blanket and is conveyed on the blanket through a nip defined between the backing roll and the concave shoe;

portions of the compliant material which are relieved below the level of the second concave surface to define at least one fluid pocket;

means for introducing a lubricant fluid into said at least one pocket, the fluid disposed therein serving to support the bearing blanket as it travels over the shoe;

a first support means cooperating with the shoe urging the shoe towards the backing roll;

a second support means disposed upstream relative to the first support means, the second support means cooperating with the shoe for urging the shoe towards the backing roll; and control means connected to the first and second support means for controlling the first and second support means, the arrangement being structured such that the application of differential pressure in a machine direction is permitted.

23. The press apparatus of claim 22 wherein the means for introducing lubricant fluid discharges lubricant into the at least one pocket through at least one lubricant supply channel defined in the shoe by portions of the metal core.

24. The apparatus of claim 22, wherein the complaint material comprises an elastomer.

25. The apparatus of claim 24, wherein the elastomer is coated with tetrafluoroethylene fluorocarbon polymers.

26. The apparatus of claim 24, wherein the elastomer is reinforced with polyester fabric.

27. The apparatus of claim 22, wherein the compliant material is an elastomer selected from the group consisting of nitrile rubber, plastics, and fluoroelastomers.

28. The apparatus of claim 22, wherein the compliant material is an elastomer having a hardness of from about 30 to about 90 shore A durometer.

29. The apparatus of claim 22, wherein the layer of compliant material has a uniform thickness of from about 0.1 to about 0.5 inches.

30. A press apparatus for a papermaking machine, comprising:

a rotatably mounted backing roll;

an elongated shoe having a metal core with a concave surface facing the backing roll, the shoe being urged toward the backing roll to define a nip therebetween for the passage therethrough of a paper web, a layer of compliant material fixed to the metal core such that the compliant material overlies the concave surface;

a bearing blanket movably disposed between the backing roll and the layer of compliant material; and means for supplying lubricant between the bearing blanket and the layer of compliant material, such that the blanket is slidingly supported by the layer of compliant material during passage of the blanket through the nip;

a first support means cooperating with the shoe urging the shoe towards the backing roll;

a second support means disposed upstream relative to the first support means, the second support means cooperating with the shoe for urging the shoe towards the backing roll; and control means connected to the first and second support means for controlling the first and second support means, the arrangement being structured such that the application of differential pressure in a machine direction is permitted.

31. The apparatus of claim 30 wherein the layer of compliant material has two parallel edge clamps which are fixed to opposite edges of the layer, and wherein each edge clamp is received within a bracket fixed to the shoe for expeditious insertion of the edge clamps into the brackets.

32. The apparatus of claim 31 further comprising a plurality of set screws extending from the brackets to the edge clamps to adjustably position the compliant layer with respect to the shoe.

* * * * *